US010923816B2

(12) United States Patent
Shen

(10) Patent No.: US 10,923,816 B2
(45) Date of Patent: Feb. 16, 2021

(54) ANTENNA SYSTEM OF MOBILE TERMINAL AND MOBILE TERMINAL

(71) Applicant: AAC Technologies Pte. Ltd., Singapore (SG)

(72) Inventor: Yachuan Shen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 38 days.

(21) Appl. No.: 16/524,215

(22) Filed: Jul. 29, 2019

(65) Prior Publication Data

US 2020/0044341 A1 Feb. 6, 2020

(30) Foreign Application Priority Data

Aug. 3, 2018 (CN) ..... 201821245508.8

(51) Int. Cl.
*H01Q 5/335* (2015.01)
*H01Q 9/04* (2006.01)
*H01Q 1/24* (2006.01)

(52) U.S. Cl.
CPC ..... *H01Q 5/335* (2015.01); *H01Q 1/242* (2013.01); *H01Q 9/0414* (2013.01)

(58) Field of Classification Search
None
See application file for complete search history.

(56) References Cited

U.S. PATENT DOCUMENTS

2018/0115054 A1* 4/2018 Wu ..... H01Q 5/35
2018/0375196 A1* 12/2018 Han ..... H01Q 5/328

* cited by examiner

*Primary Examiner* — Jany Richardson
(74) *Attorney, Agent, or Firm* — W&G Law Group LLP

(57) ABSTRACT

The present disclosure provides an antenna system of a mobile terminal. The mobile terminal includes a housing, a mainboard accommodated in the housing, a plastic holder covering the mainboard, and a USB interface installed on the mainboard. The antenna system includes a radiator formed on a surface of the plastic holder facing the housing, and a feed end, a first ground point and a second ground point that are disposed on the mainboard. The radiator includes a feed end and a ground feed end spaced apart from each other, a connection end connecting the feed end and the ground feed end, a first stub connected to the ground feed end, and a second stub and a third stub connected to the feed end. The antenna system provided by the present disclosure is more space-saving, and reduces the impact of the USB interface on the antenna.

18 Claims, 7 Drawing Sheets

ANTENNA SYSTEM OF MOBILE TERMINAL AND MOBILE TERMINAL

TECHNICAL FIELD

The present disclosure relates to the field of wireless communications technologies, more particularly to an antenna system of a mobile terminal and the mobile terminal.

BACKGROUND

Portable mobile terminals such as mobile phones and tablet computers are all equipped with antenna systems, to receive and transmit electromagnetic wave signals for wireless communications.

As a mobile terminal tends to be thinner in design, but limited by the size of the mobile terminal, the arrangement between an antenna system and other components inside the mobile terminal is inevitably compact. Usually, a radiator of the antenna system is disposed across a universal serial bus (USB) interface, causing interference of the USB interface to the antenna. In addition, to satisfy a multiple-input multiple-output (MIMO) requirement, the quantity of antennas disposed inside the mobile terminal is increasing, further increasing the difficulty in arranging the antenna system and the components inside the mobile terminal.

Therefore, it is necessary to provide a new antenna system to resolve the above problems.

BRIEF DESCRIPTION OF THE DRAWINGS

To describe the technical solutions in the embodiments of the present disclosure more clearly, the following briefly describes the accompanying drawings required for describing the embodiments. Apparently, the accompanying drawings in the following description are merely some embodiments of the present disclosure, and those of ordinary skill in the art can derive other accompanying drawings from these accompanying drawings without creative efforts.

DETAILED DESCRIPTION

Figure 1:
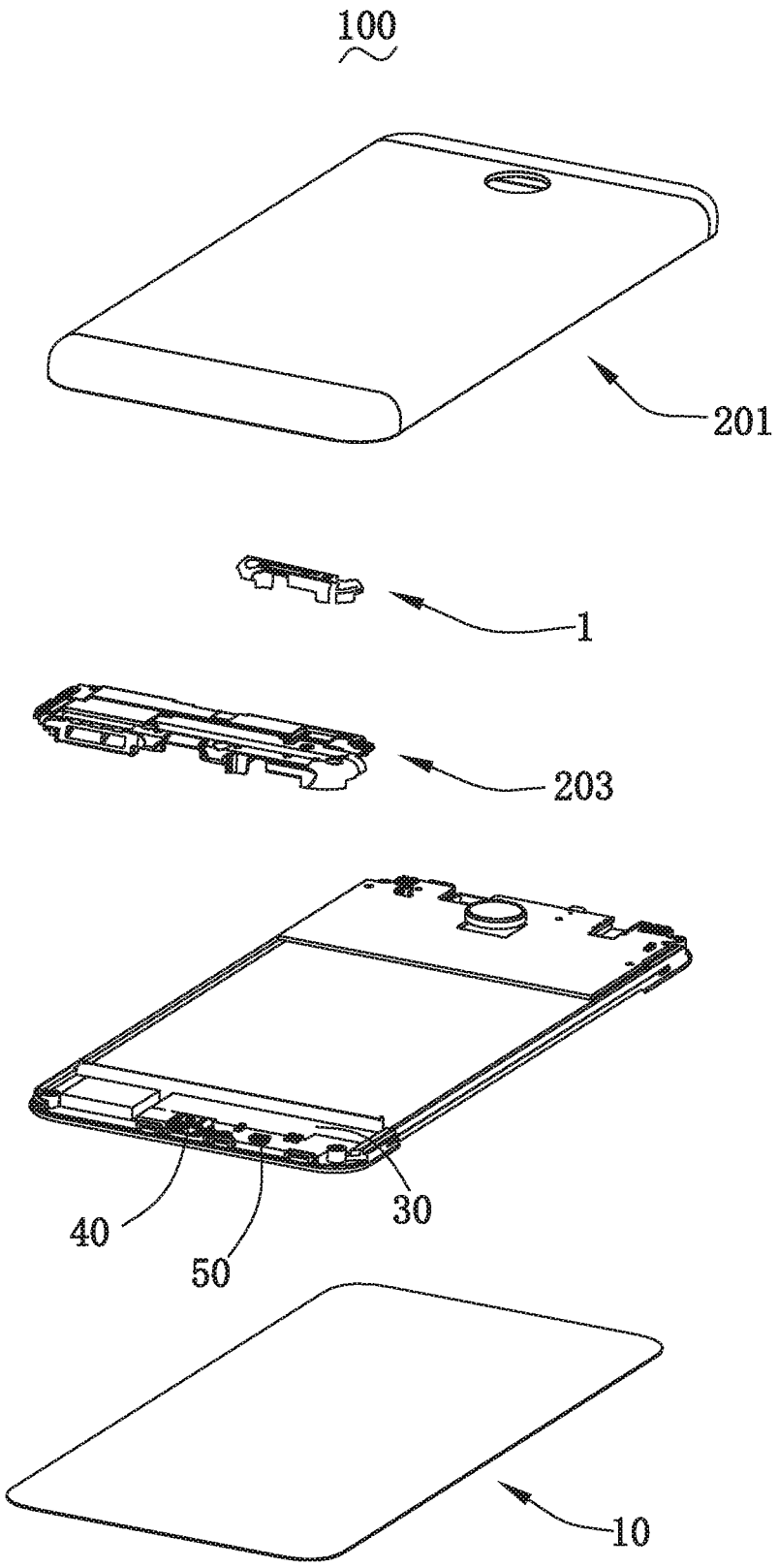
FIG. 1 is an exploded schematic diagram of a mobile terminal according to an embodiment of the present disclosure.
Figure 2:
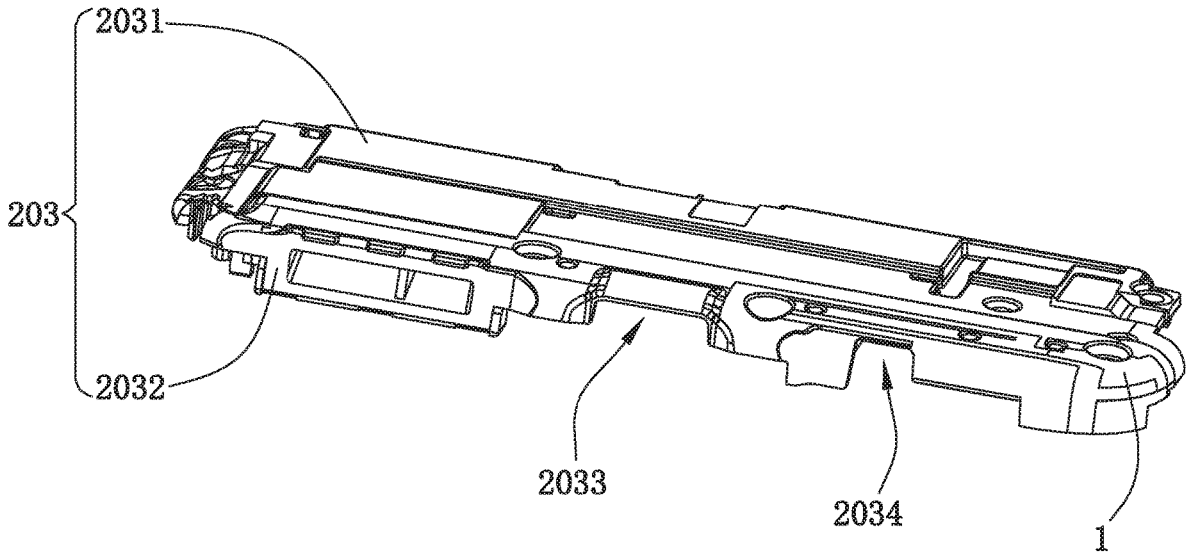
FIG. 2 is a schematic structural diagram showing assembly of a radiator on a plastic holder in the mobile terminal shown in FIG. 1.
Figure 3:
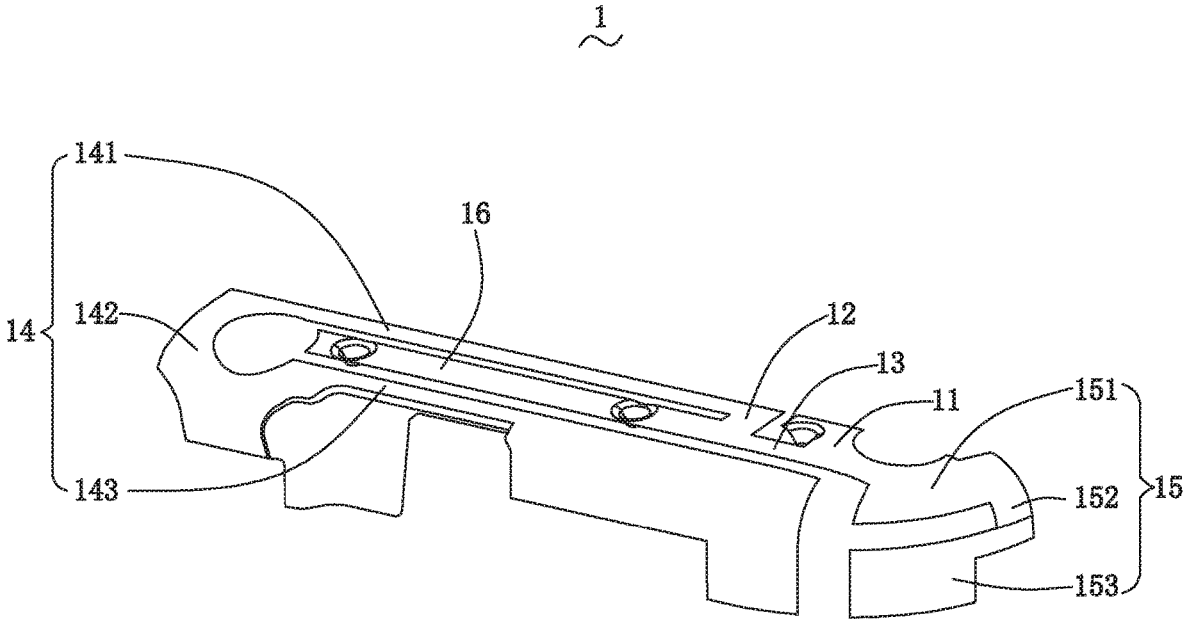
FIG. 3 is a schematic structural diagram of a radiator in the mobile terminal shown in FIG. 1.
Figure 4:
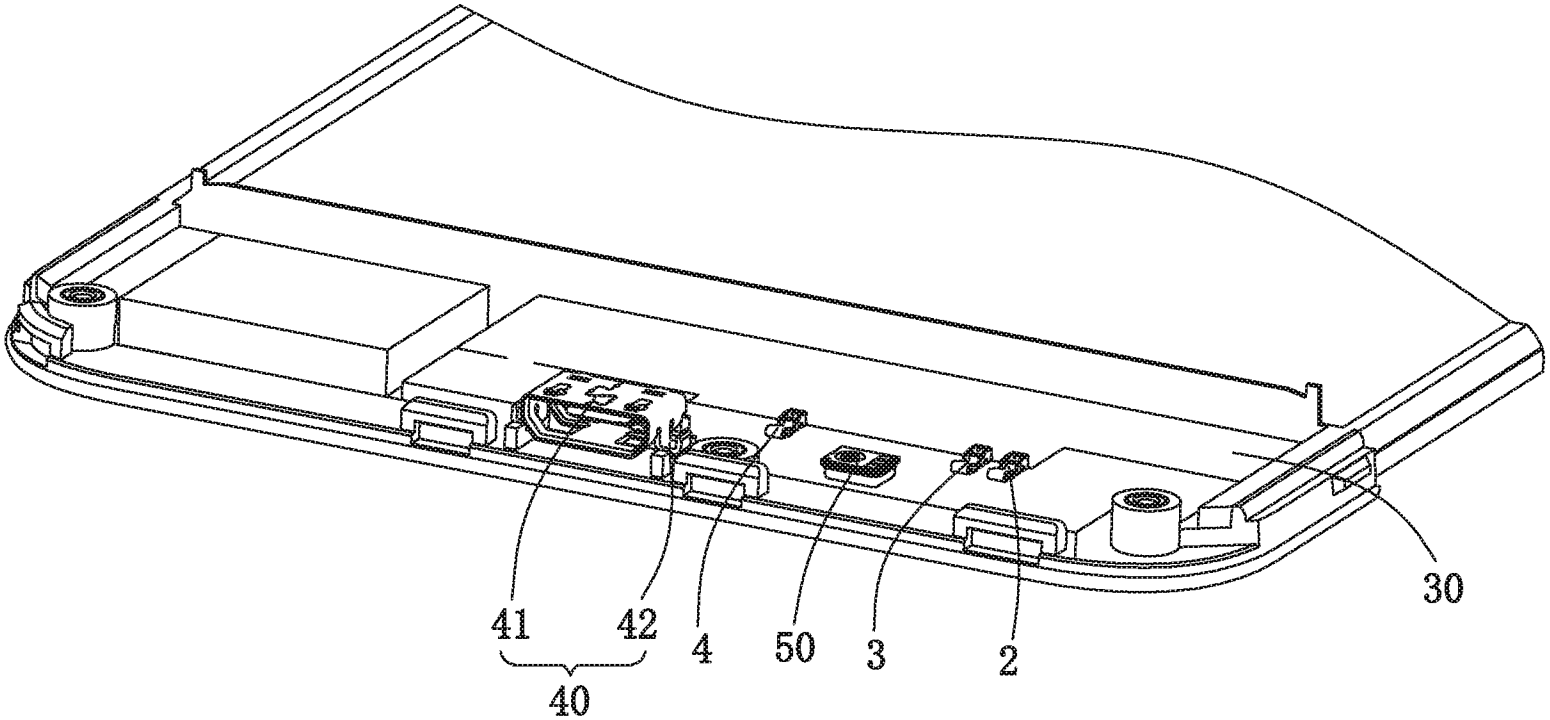
FIG. 4 is a three-dimensional schematic structural diagram showing a part of the mobile terminal shown in FIG. 2.

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the protection scope of the present disclosure.

As shown in FIG. 1 to FIG. 4, an embodiment of the present disclosure provides an antenna system of a mobile terminal, the antenna system can receive and transmit electromagnetic wave signals, to further implement a communications function of the mobile terminal. The mobile terminal herein may be a mobile phone, an ipad, a POS machine, and the like. This is not limited in the present disclosure.

Specifically, the mobile terminal 100 provided in an embodiment of the present disclosure includes a screen 10, a housing 201 supporting the screen 10 and defining an accommodation space together with the screen, a mainboard 30 accommodated in the housing 201, a USB interface 40 and a microphone 50 installed on the mainboard 30, and an antenna system. The USB interface 40 is used by the mobile terminal to connect and communicate with an external device, including a housing portion 41 and gripper foot portions 42 disposed on two sides of the housing portion 41 and connected to the mainboard 30. The microphone 50 is used to convert sound signals into electrical signals, to make the mobile terminal implement the functions of calling and recording, and the antenna system is used by the mobile terminal to implement communications functions.

The mobile terminal 100 further includes a plastic holder 203 disposed in the housing 201 and covering the mainboard 30.

The plastic holder 203 includes a first portion 2031 disposed opposite to the mainboard 30, and a second portion 2032 extending from an edge of the first portion 2031 to a direction close to the mainboard 30. The second portion 2032 is provided with a first through hole 2033 in communication with a front end of the USB interface 40, and a second through hole 2034 in communication with a front end of the microphone 50.

The antenna system includes a radiator 1 formed on a surface of the plastic holder 203, and a feed point 2, a first ground point 3 and a second ground point 4 that are disposed on the mainboard 30, a first matching circuit 5, a second matching circuit 6, and a tuning switch 7. An orthographic projection of the radiator 1 and an orthographic projection of the housing portion 41 of the USB interface 40 on the mainboard 30 do not overlap with each other. The radiator 1 is formed on the surface of the plastic holder 203 facing the housing 201 through a laser direct structuring (LDS) process. In an embodiment, the radiator 1 is arranged at a lower right corner of the housing 201. On the one hand, compared with the conventional solutions, the antenna system is more space-saving and more suitable for a MIMO terminal having an increased quantity of antennas. On the other hand, the radiator 1 does not cross the USB interface 40, reducing the impact of the USB interface 40 on the antenna. In addition, it is convenient to adjust the location of the radiator 1 or the USB interface 40, and a larger operational space is provided.

The radiator 1 includes a feed end 11 and a ground feed end 12 spaced apart from each other in a short-axis direction of the mobile terminal 100, a connection end 13 connecting the feed end 11 and the ground feed end 12, a first stub 14 connected to the ground feed end 12, a second stub 15 connected to the feed end 11, and a third stub 16 connected to the ground feed end 12. The first stub 14 and the second stub 15 are both bent to form a semi-closed structure having an opening, and the opening of the first stub 14 and the opening of the second stub 15 are opposite to and spaced apart from each other. The third stub 16 is located in the opening of the first stub 14. The feed end 11, the ground feed end 12 and the connection end 13 are all located at the first portion 2031. The connection end 13 is connected to an end of the feed end 11 and the ground feed end 12 close to the second portion 2032. The first stub 14 includes a first branch 141 extending from one end of the ground feed end 12 away from the connection end 13 to a direction way from the feed end 11 along a short axis of the mobile terminal 100, a second branch 142 extending from one end of the first branch 141 away from the ground feed end 12 to the second portion 2032, and a third branch 143 extending from one end of the second branch 142 away from the first branch 141 to a direction close to the feed end 11 along the short axis of the mobile terminal 100. The second stub 15 includes a fourth branch 151 extending from the feed end 11 to a direction away from the ground feed end 12, a fifth branch 152 extending from the fourth branch 151 to the second portion 2032, and a sixth branch 153 extending from one end of the fifth branch 152 away from the fourth branch 151 to a direction close to the ground feed end 12. The third stub 16 extends from one end of the ground feed end 12 close to the connection end 13 to a direction away from the feed end 11 along the short axis of the mobile terminal 100, and the third stub 16 is spaced apart from the first branch 141, the second branch 142, and the third branch 143.

The feed point 2 is connected to the feed end 11 through the first matching circuit 5, the first ground point 3 is connected to the ground feed end 12 through the second matching circuit 6, and the second ground point 4 is connected to the first stub 14 through the tuning switch 7. More preferably, the tuning switch 7 is connected to the first branch 141.

In an embodiment, a clearance area (unnumbered) is arranged on the mainboard 30. An orthographic projection of the antenna system to the mainboard 30 is located in the clearance area. The USB interface 40 is located at a middle position of the bottom of the mobile terminal 100, the microphone 50 is disposed on one side of the USB interface 40 and located below the radiator 1, the second ground point 4 is located between the USB interface 40 and the microphone 50, and the first ground point 3 and the feed end 2 are located at one side of the microphone 50 away from the USB interface 40.

Figure 5:
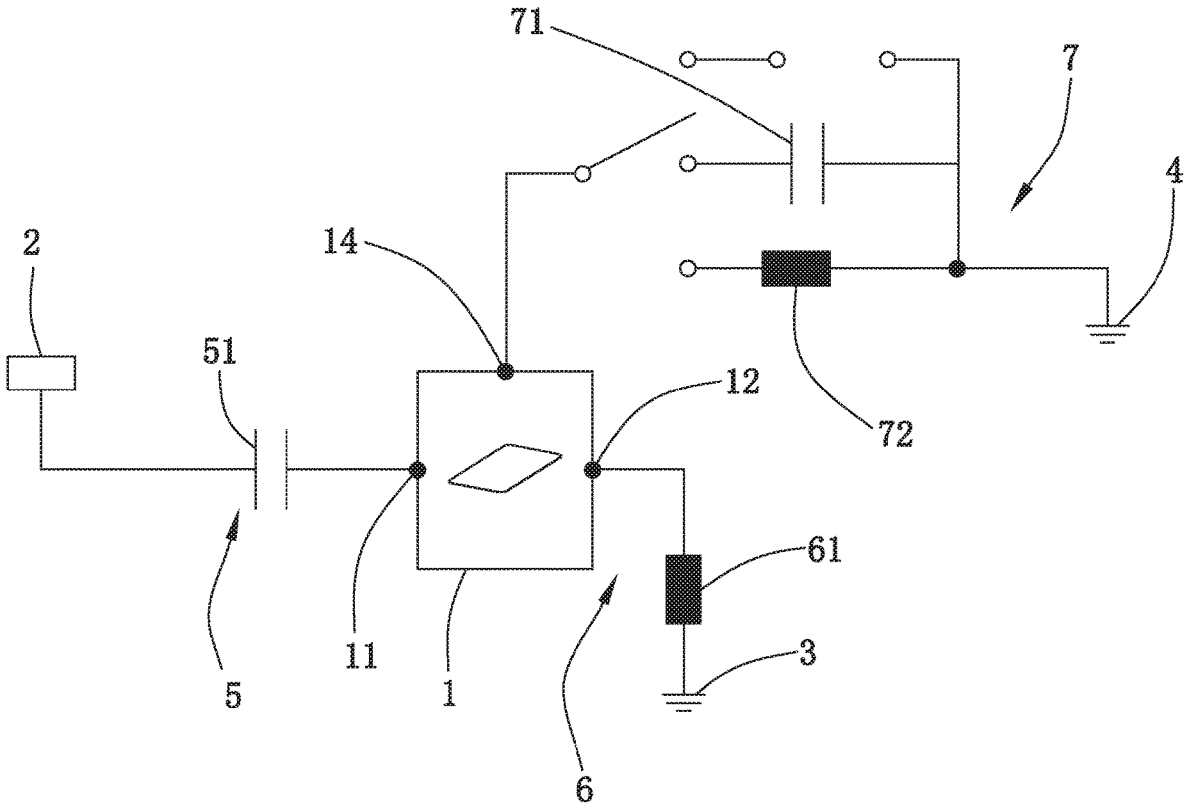
FIG. 5 is a schematic structural diagram showing circuit connection in an antenna system of the mobile terminal shown in FIG. 1.

Refer to FIG. 5, the first matching circuit 5 includes a second capacitor 51, one end of the second capacitor 51 is connected to the feed end 11 of the radiator 1, and the other end is connected to the feed point 2.

The second matching circuit 6 includes a second inductor 61, one end of the second inductor 61 is connected to the ground feed end 12 of the radiator 1, and the other end is connected to the first ground point 3.

The tuning switch 7 has an open circuit state, a first capacitor access state and a first inductor access state. When the tuning switch 7 is in the open circuit state, the first stub 14 is disconnected from the second ground point 4. When the tuning switch 7 is in the first capacitor access state, the first stub 14 is connected to the second ground point 4 through the first capacitor 71. When the tuning switch 7 is in the first inductor access state, the first stub 14 is connected to the second ground point 4 through the first inductor 72.

Preferably, a capacitance value of the first capacitor 71 is 0.6 pF, and an inductance value of the first inductor 72 is 84 nH. A capacitance value of the second capacitor is 8 pF, and an inductance value of the second inductor is 2 nH. When the tuning switch 7 is in the first capacitor access state, the radiator 1 covers an operating band of 790 to 862 MHz. When the tuning switch 7 is in the open circuit state, the radiator 1 covers an operating band of 814 to 894 MHz. When the tuning switch 7 is in the first inductor access state, the radiator 1 covers an operating band of 880 to 960 MHz and an operating band of 1710 to 2690 MHz.

Figure 6:
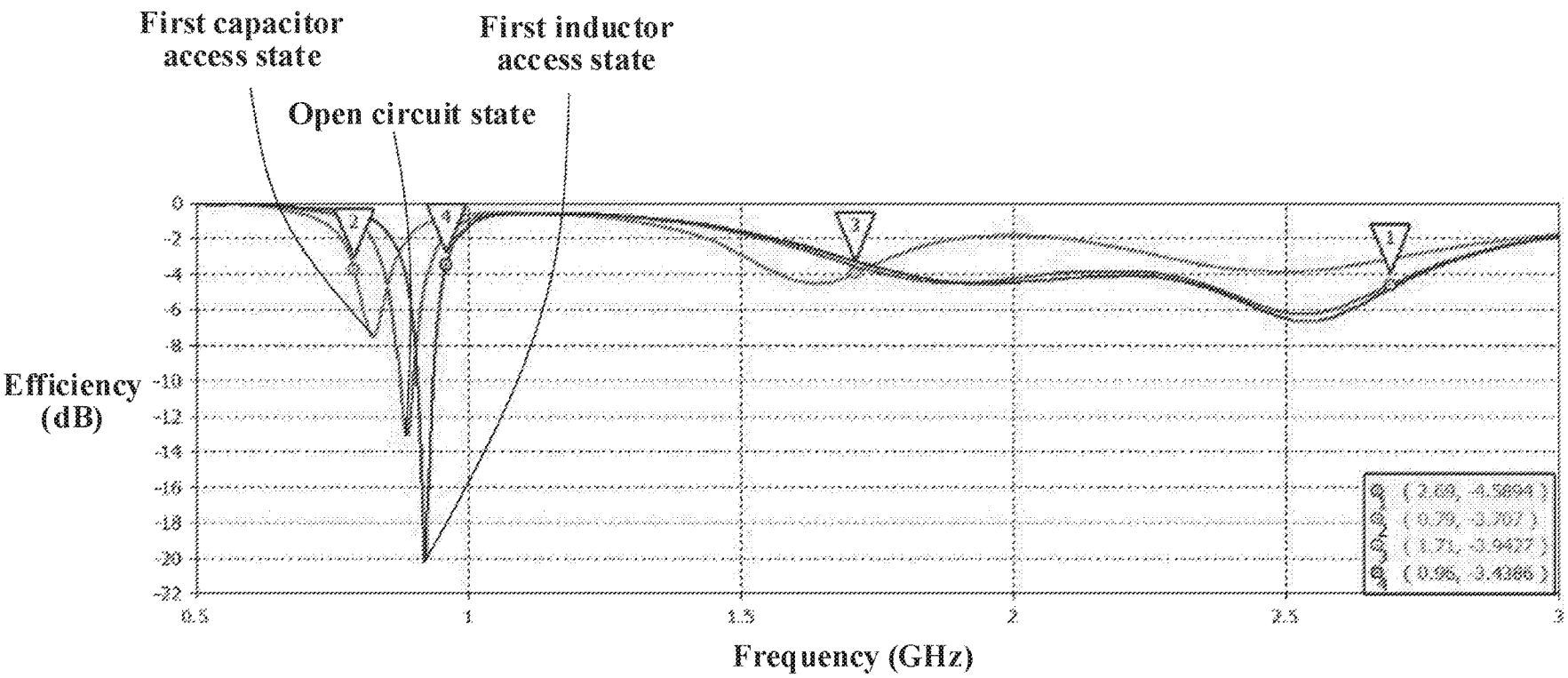
FIG. 6 is a curve graph showing a return loss simulation effect of an antenna system of a mobile terminal according to an embodiment of the present disclosure.
Figure 7:
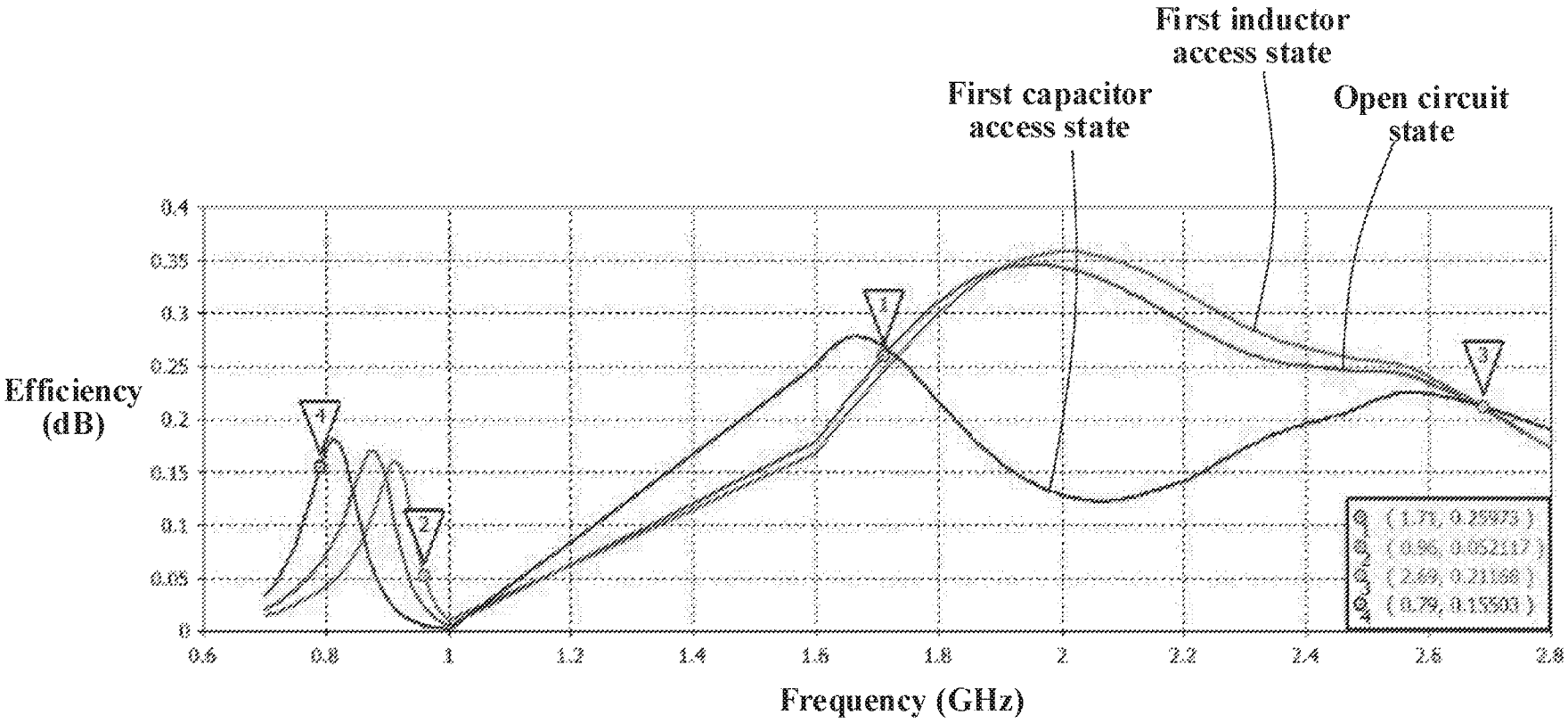
FIG. 7 is a curve graph showing an antenna efficiency simulation effect of an antenna system of a mobile terminal according to an embodiment of the present disclosure.

Based on the above, when the tuning switch 7 in the antenna system of the present disclosure are in the open circuit state, the first capacitor access state and the first inductor access state, a return loss and a radiation efficiency of each operating band are shown in FIG. 6 and FIG. 7, where abscissas in FIG. 6 and FIG. 7 represent frequencies, measured in GHz. Ordinates in FIG. 6 and FIG. 7 respectively represent a return loss value and a radiation efficiency, both of which are measured in dB.

The radiator of the antenna system provided in the present disclosure is arranged at a lower right corner of the housing of the mobile terminal, and an orthographic projection of the radiator and an orthographic projection of the housing portion of the USB interface on the mainboard do not overlap with each other. On the one hand, compared with the conventional solutions, the antenna system is more space-saving and more suitable for the MIMO terminal having an increased quantity of antennas. On the other hand, the radiator does not cross the USB interface, reducing the impact of the USB interface on the antenna. In addition, it is convenient to adjust the locations of the radiator and the USB interface, and a larger operational space is provided.

The foregoing descriptions are merely embodiments of the present disclosure but are not intended to limit the patent scope of the present disclosure, an equivalent structure or equivalent procedure replacement made based on the content of the specification and the accompanying drawings of the present disclosure or directly or indirectly applied in other relevant technical fields are all included in the patent protection scope of the present disclosure.

What is claimed is:

1. An antenna system of a mobile terminal, the mobile terminal comprises a housing, a mainboard accommodated in the housing, a plastic holder covering the mainboard, and a USB interface installed on the mainboard; and the antenna system comprises a radiator formed on a surface of the plastic holder facing the housing, and a feed point, a first ground point and a second ground point that are disposed on the mainboard;

wherein the radiator comprises a feed end and a ground feed end spaced apart from each other in a short-axis direction of the mobile terminal, a connection end connecting the feed end and the ground feed end, a first stub connected to the ground feed end, and a second stub connected to the feed end, the first stub and the second stub are both bent to form a semi-closed structure having an opening, and the opening of the first stub and the opening of the second stub are opposite to and spaced apart from each other;

the radiator further comprises a third stub connected to the ground feed end and located in the opening of the first stub;

the antenna system further comprises a first matching circuit, a second matching circuit and a tuning switch;

the feed end is connected to the feed point through the first matching circuit, the ground feed end is connected to the first ground point through the second matching circuit, the first stub is connected to the second ground point through the tuning switch, the USB interface comprises a housing portion and gripper foot portions disposed on two sides of the housing portion and connected to the mainboard, and an orthographic projection of the radiator and an orthographic projection of the housing portion on the mainboard do not overlap with each other.

2. The antenna system according to claim 1, wherein the plastic holder comprises a first portion disposed opposite to the mainboard, and a second portion extending from an edge of the first portion to a direction close to the mainboard, the feed end, the ground feed end and the connection end are all located at the first portion, the connection end is connected to an end of the feed end and the ground feed end close to the second portion, the first stub comprises a first branch extending from one end of the ground feed end away from the connection end to a direction away from the feed end along a short axis of the mobile terminal, a second branch extending from one end of the first branch away from the ground feed end to the second portion, and a third branch extending from one end of the second branch away from the first branch to a direction close to the feed end along the short axis of the mobile terminal;

the second stub comprises a fourth branch extending from the feed end to a direction away from the ground feed end, a fifth branch extending from the fourth branch to the second portion, and a sixth branch extending from one end of the fifth branch away from the fourth branch to a direction close to the ground feed end;

the third stub extends from one end of the ground feed end close to the connection end to a direction away from the feed end along the short axis of the mobile terminal, and the third stub is disposed spaced apart from the first branch, the second branch, and the third branch.

3. The antenna system according to claim 2, wherein the tuning switch is connected to the first branch.

4. The antenna system according to claim 1, wherein the tuning switch has an open circuit state, a first capacitor access state and a first inductor access state;

when the tuning switch is in the open circuit state, the first stub is disconnected from the second ground point;

when the tuning switch is in the first capacitor access state, the first stub is connected to the second ground point through the first capacitor; and when the tuning switch is in the first inductor access state, the first stub is connected to the second ground point through the first inductor.

5. The antenna system according to claim 4, wherein a capacitance value of the first capacitor is 0.6 pF, and an inductance value of the first inductor is 84 nH;

the first matching circuit comprises a second capacitor having a capacitance value of 8 pF, one end of the second capacitor is connected to the feed end, and the other end is connected to the feed end;

the second matching circuit comprises a second inductor having an inductance value of 2 nH, one end of the second inductor is connected to the ground feed end, and the other end is connected to the first ground point;

when the tuning switch is in the first capacitor access state, the radiator covers an operating band of 790 to 862 MHz;

when the tuning switch is in the open circuit state, the radiator covers an operating band of 814 to 894 MHz; and when the tuning switch is in the first inductor access state, the radiator covers an operating band of 880 to 960 MHz and an operating band of 1710 to 2690 MHz.

6. The antenna system according to claim 1, wherein the radiator is formed on the surface of the plastic holder facing the housing through a LDS process.

7. A mobile terminal, comprising the antenna system according to claim 1.

8. The mobile terminal according to claim 7, wherein the plastic holder comprises a first portion disposed opposite to the mainboard, and a second portion extending from an edge of the first portion to a direction close to the mainboard, the feed end, the ground feed end and the connection end are all located at the first portion, the connection end is connected to an end of the feed end and the ground feed end close to the second portion, the first stub comprises a first branch extending from one end of the ground feed end away from the connection end to a direction away from the feed end along a short axis of the mobile terminal, a second branch extending from one end of the first branch away from the ground feed end to the second portion, and a third branch extending from one end of the second branch away from the first branch to a direction close to the feed end along the short axis of the mobile terminal;

the second stub comprises a fourth branch extending from the feed end to a direction away from the ground feed end, a fifth branch extending from the fourth branch to the second portion, and a sixth branch extending from one end of the fifth branch away from the fourth branch to a direction close to the ground feed end;

the third stub extends from one end of the ground feed end close to the connection end to a direction away from the feed end along the short axis of the mobile terminal, and the third stub is disposed spaced apart from the first branch, the second branch, and the third branch.

9. The mobile terminal according to claim 8, wherein the tuning switch is connected to the first branch.

10. The mobile terminal according to claim 9, wherein the mobile terminal further comprises a microphone installed on the mainboard and located below the radiator, the second ground point is located between the USB interface and the microphone, and the first ground point and the feed end are located on one side of the microphone away from the USB interface.

11. The mobile terminal according to claim 8, wherein the mobile terminal further comprises a microphone installed on the mainboard and located below the radiator, the second ground point is located between the USB interface and the microphone, and the first ground point and the feed end are located on one side of the microphone away from the USB interface.

12. The mobile terminal according to claim 7, wherein the tuning switch has an open circuit state, a first capacitor access state and a first inductor access state;

when the tuning switch is in the open circuit state, the first stub is disconnected from the second ground point;

when the tuning switch is in the first capacitor access state, the first stub is connected to the second ground point through the first capacitor; and when the tuning switch is in the first inductor access state, the first stub is connected to the second ground point through the first inductor.

13. The mobile terminal according to claim 12, wherein a capacitance value of the first capacitor is 0.6 pF, and an inductance value of the first inductor is 84 nH;

the first matching circuit comprises a second capacitor having a capacitance value of 8 pF, one end of the second capacitor is connected to the feed end, and the other end is connected to the feed end;

the second matching circuit comprises a second inductor having an inductance value of 2 nH, one end of the second inductor is connected to the ground feed end, and the other end is connected to the first ground point;

when the tuning switch is in the first capacitor access state, the radiator covers an operating band of 790 to 862 MHz;

when the tuning switch is in the open circuit state, the radiator covers an operating band of 814 to 894 MHz; and when the tuning switch is in the first inductor access state, the radiator covers an operating band of 880 to 960 MHz and an operating band of 1710 to 2690 MHz.

14. The mobile terminal according to claim 13, wherein the mobile terminal further comprises a microphone installed on the mainboard and located below the radiator, the second ground point is located between the USB interface and the microphone, and the first ground point and the feed end are located on one side of the microphone away from the USB interface.

15. The mobile terminal according to claim 12, wherein the mobile terminal further comprises a microphone installed on the mainboard and located below the radiator, the second ground point is located between the USB interface and the microphone, and the first ground point and the feed end are located on one side of the microphone away from the USB interface.

16. The mobile terminal according to claim 7, wherein the radiator is formed on the surface of the plastic holder facing the housing through a LDS process.

17. The mobile terminal according to claim 16, wherein the mobile terminal further comprises a microphone installed on the mainboard and located below the radiator, the second ground point is located between the USB interface and the microphone, and the first ground point and the feed end are located on one side of the microphone away from the USB interface.

18. The mobile terminal according to claim 7, wherein the mobile terminal further comprises a microphone installed on the mainboard and located below the radiator, the second ground point is located between the USB interface and the microphone, and the first ground point and the feed end are located on one side of the microphone away from the USB interface.

* * * * *